US009519240B1

(12) United States Patent
Ozawa

(10) Patent No.: US 9,519,240 B1
(45) Date of Patent: Dec. 13, 2016

(54) DEVELOPING DEVICE, ASSEMBLY, AND IMAGE FORMING APPARATUS

(71) Applicant: FUJI XEROX CO., LTD., Tokyo (JP)

(72) Inventor: Hideaki Ozawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/011,054

(22) Filed: Jan. 29, 2016

(30) Foreign Application Priority Data

Jul. 24, 2015 (JP) ..... 2015-146741

(51) Int. Cl.
*G03G 15/08* (2006.01)

(52) U.S. Cl.
CPC ..... *G03G 15/0808* (2013.01)

(58) Field of Classification Search
CPC ..... G03G 15/0808
See application file for complete search history.

(56) References Cited

U.S. PATENT DOCUMENTS 6,249,661 B1 6/2001 Saitoh et al.
2012/0003012 A1* 1/2012 Kato ..... G03G 15/0808 399/222
2013/0028630 A1* 1/2013 Ito ..... G03G 15/0817 399/103
2013/0029820 A1* 1/2013 Huang ..... B41J 13/076 492/48

FOREIGN PATENT DOCUMENTS

JP H08-320634 A 12/1996
JP H11-212430 A 8/1999

* cited by examiner

*Primary Examiner* — Sandra Brase
(74) *Attorney, Agent, or Firm* — Oliff PLC

(57) ABSTRACT

Provided is a developing device including a rotating member that faces a formation target member on which a toner image is formed, is rotated around a rotation shaft extruded from an end portion, and includes a holding portion having an outer circumference on which a toner is held, an accommodation member that accommodates the toner, includes a wall at which a notch is formed, and in which the rotating member is disposed in a state where the rotation shaft is extruded outwardly from an inner surface of the wall through the notch, and a fixation member that is fixed on both sides of an inner surface of the wall with interposing the notch.

14 Claims, 9 Drawing Sheets

DEVELOPING DEVICE, ASSEMBLY, AND IMAGE FORMING APPARATUS

CROSS-REFERENCE TO RELATED APPLICATIONS

This application is based on and claims priority under 35 USC 119 from Japanese Patent Application No. 2015-146741 filed Jul. 24, 2015.

BACKGROUND

Technical Field

The present invention relates to a developing device, an assembly, and an image forming apparatus.

SUMMARY

According to an aspect of the invention, there is provided a developing device including:

a rotating member that faces a formation target member on which a toner image is formed, is rotated around a rotation shaft extruded from an end portion, and includes a holding portion having an outer circumference on which a toner is held;

an accommodation member that accommodates the toner, includes a wall at which a notch is formed, and in which the rotating member is disposed in a state where the rotation shaft is extruded outwardly from an inner surface of the wall through the notch; and a fixation member that is fixed on both sides of an inner surface of the wall with interposing the notch.

BRIEF DESCRIPTION OF THE DRAWINGS

Exemplary embodiments of the present invention will be described in detail based on the following figures, wherein.

DETAILED DESCRIPTION

Overview

Figure 1:
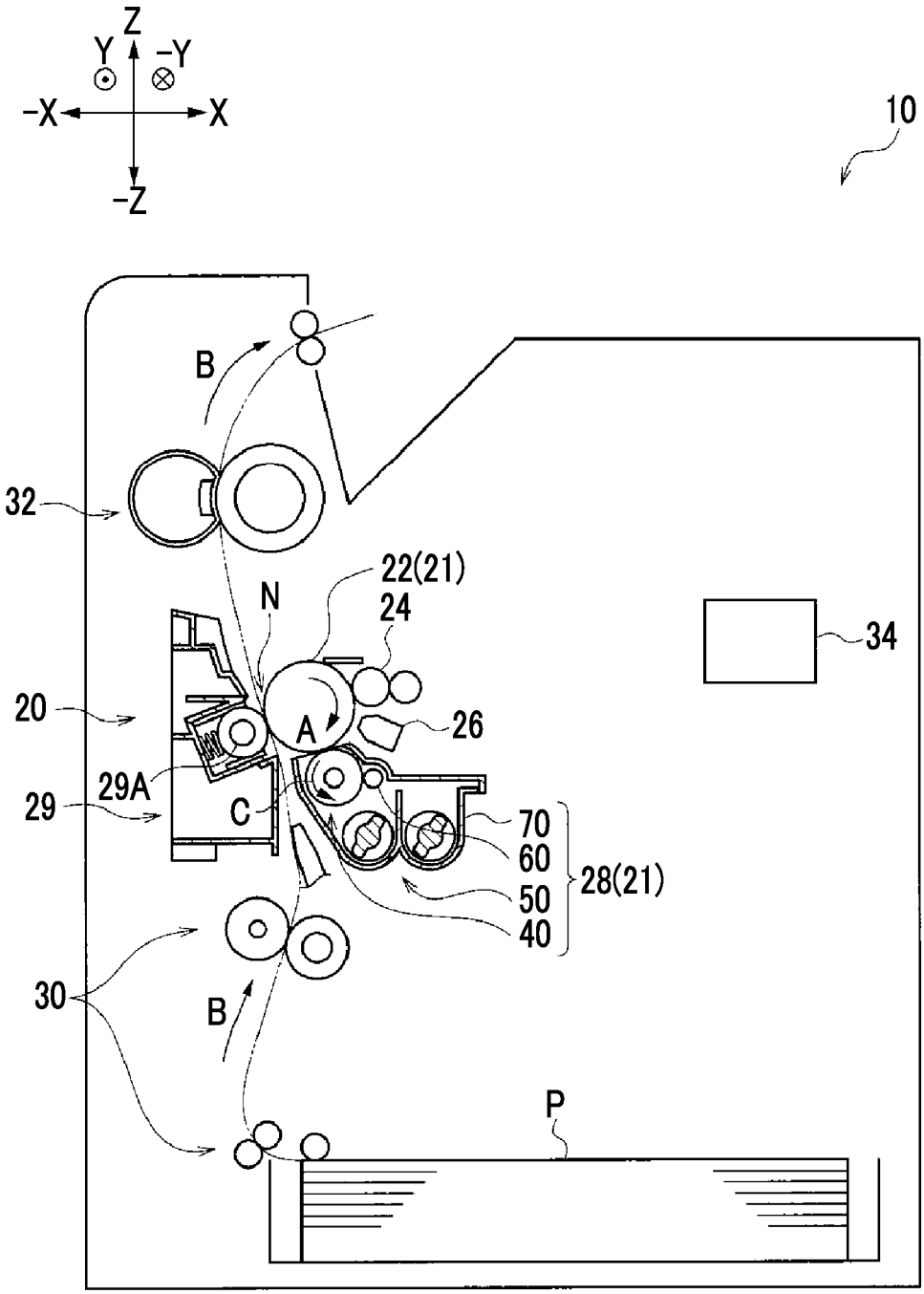
FIG. 1 is a schematic diagram (front view) illustrating an image forming apparatus according to an exemplary embodiment.

Hereinafter, a form (exemplary embodiment) for embodying the invention will be described. First, an overall configuration and operation of an image forming apparatus 10 according to an exemplary embodiment will be described. Next, the main component (developing device 28) in this exemplary embodiment will be described. Subsequently, an effect of this exemplary embodiment will be described.

In the following descriptions, in the drawings, a direction indicated by an arrow X is set as a right side in a width direction of the apparatus, and a direction indicated by an arrow −X is set as a left side in the width direction of the apparatus. A direction indicated by an arrow Z is set as an upper side in a height direction of the apparatus (referred to as an upper side below), and a direction indicated by an arrow −Z is set as a lower side in the height direction of the apparatus (referred to as a lower side below). The upper side in a height direction of the apparatus is referred to as an upper side below, and the lower side in the height direction of the apparatus is referred to as a lower side below. Directions (directions indicated by an arrow Y and an arrow −Y) perpendicular to the width direction of the apparatus and the height direction of the apparatus are set as a front side and a back side in a depth direction of the apparatus.

Overall Configuration of Image Forming Apparatus

First, an overall configuration of the image forming apparatus 10 will be described with reference to FIG. 1. As the image forming apparatus 10, an electrophotographic device is used. The electrophotographic device includes a toner image forming section 20, a transport device 30, a fixing device 32, and a control section 34.

Toner Image Forming Section

The toner image forming section 20 has a function of forming a toner image on a medium P which is transported by the transport device 30, by performing processes of charging, exposure, developing, and transfer. The toner image forming section 20 includes a photoreceptor 22, a charging device 24, an exposure device 26, a developing device 28, and a transfer device 29.

The photoreceptor 22 has a cylindrical shape, and is driven by a driving source (not illustrated) so as to be rotated around an axis (direction indicated by an arrow A). The charging device 24 has a function of charging the photoreceptor 22 which is rotated around the axis. The exposure device 26 has a function of forming a latent image on the photoreceptor 22 which is charged by the charging device 24. The developing device 28 has a function of developing the latent image which is formed on the photoreceptor 22 by the exposure device 26, by using a toner so as to obtain a toner image (function of forming a toner image). The transfer device 29 includes a transfer roll 29A. The transfer device 29 has a function of forming a nip N between the transfer roll 29A and the photoreceptor 22 and transferring the toner image which has been formed on the photoreceptor 22, to the medium P which has been transported to the nip N. Here, the photoreceptor 22 is an example of a formation target member.

In the toner image forming section 20 of the exemplary embodiment, the photoreceptor 22 and the developing device 28 constitute a cartridge 21 which is integrally attachable to a main body of an image forming apparatus. Here, the cartridge 21 is an example of an assembly.

Transport Device

The transport device 30 has a function of transporting the medium P in a transporting direction (direction indicated by an arrow B) by using a transporting path (two-dot chain line in FIG. 1) of the medium P, as a transporting path.

Fixing Device

The fixing device 32 has a function of heating and pressing the toner image which has been formed on the medium P by the toner image forming section 20, so as to fix the toner onto the medium P.

Control Section

The control section 34 has a function of controlling components other than the control section 34, which constitute the image forming apparatus 10. A specific function of the control section 34 will be described with description of an operation of the image forming apparatus.

Hitherto, the overall configuration of the image forming apparatus 10 according to the exemplary embodiment is described.

Operation of Image Forming Apparatus

An operation of the image forming apparatus 10 according to this exemplary embodiment will be described with reference to FIG. 1.

The control section 34 which receives image data from an external device (not illustrated) operates the toner image forming section 20. Thus, the charging device 24 charges the photoreceptor 22, and the exposure device 26 exposes the photoreceptor 22 so as to form a latent image. The developing device 28 develops the latent image and thus a toner image is formed on the photoreceptor 22.

The control section 34 operates the transport device 30 to send the medium P to the nip N at a timing at which the toner image formed on the photoreceptor 22 reaches the nip N by rotation of the photoreceptor 22. The control section 34 controls the transfer device 29 to transfer the toner image formed on the photoreceptor 22 to the medium P.

Then, the fixing device 32 heats and presses the toner image which has been transferred to the medium P by the transfer device 29, so as to fix the toner image to the medium P. The medium P to which the toner image is fixed is discharged to the outside of the image forming apparatus 10 by the transport device 30 and then the operation of the image forming apparatus 10 is ended.

Hitherto, the operation of the image forming apparatus 10 is described.

Configuration of Main Component

Figure 2:
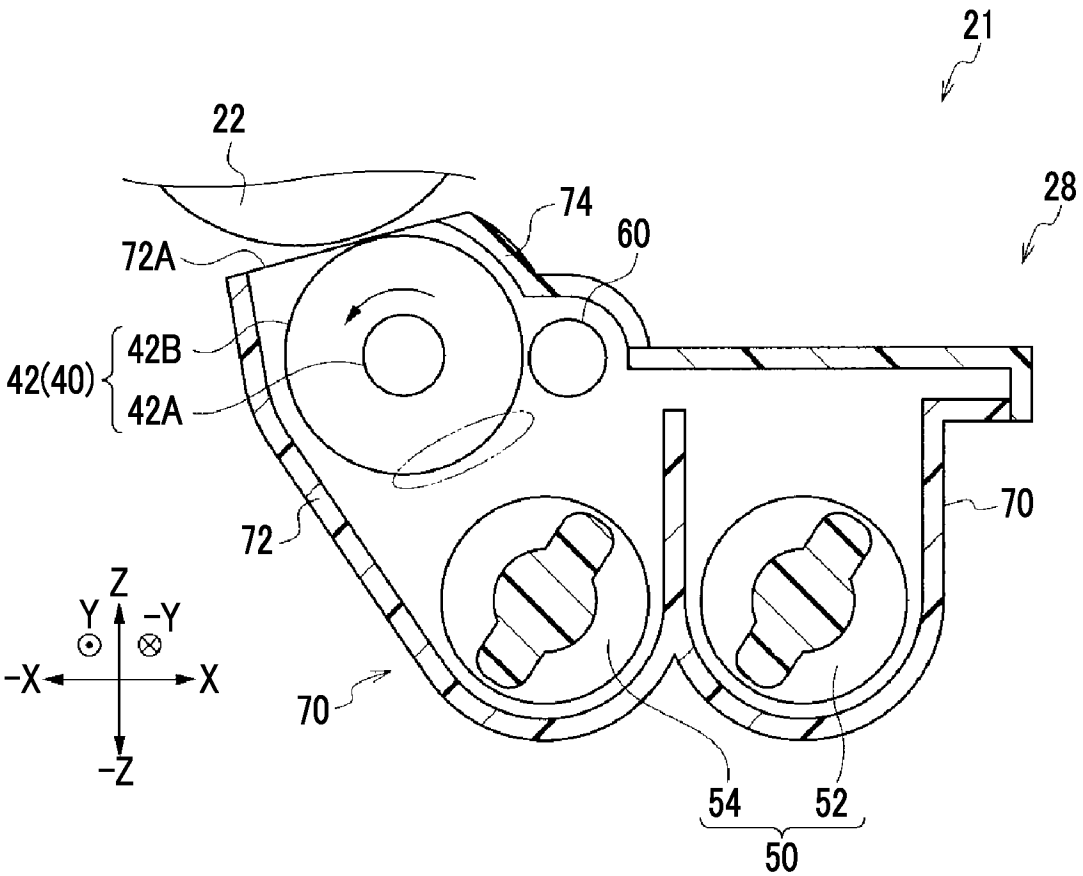
FIG. 2 is a schematic diagram (front view) illustrating a portion of a developing device and a photoreceptor which constitute the image forming apparatus according to the exemplary embodiment.
Figure 3:
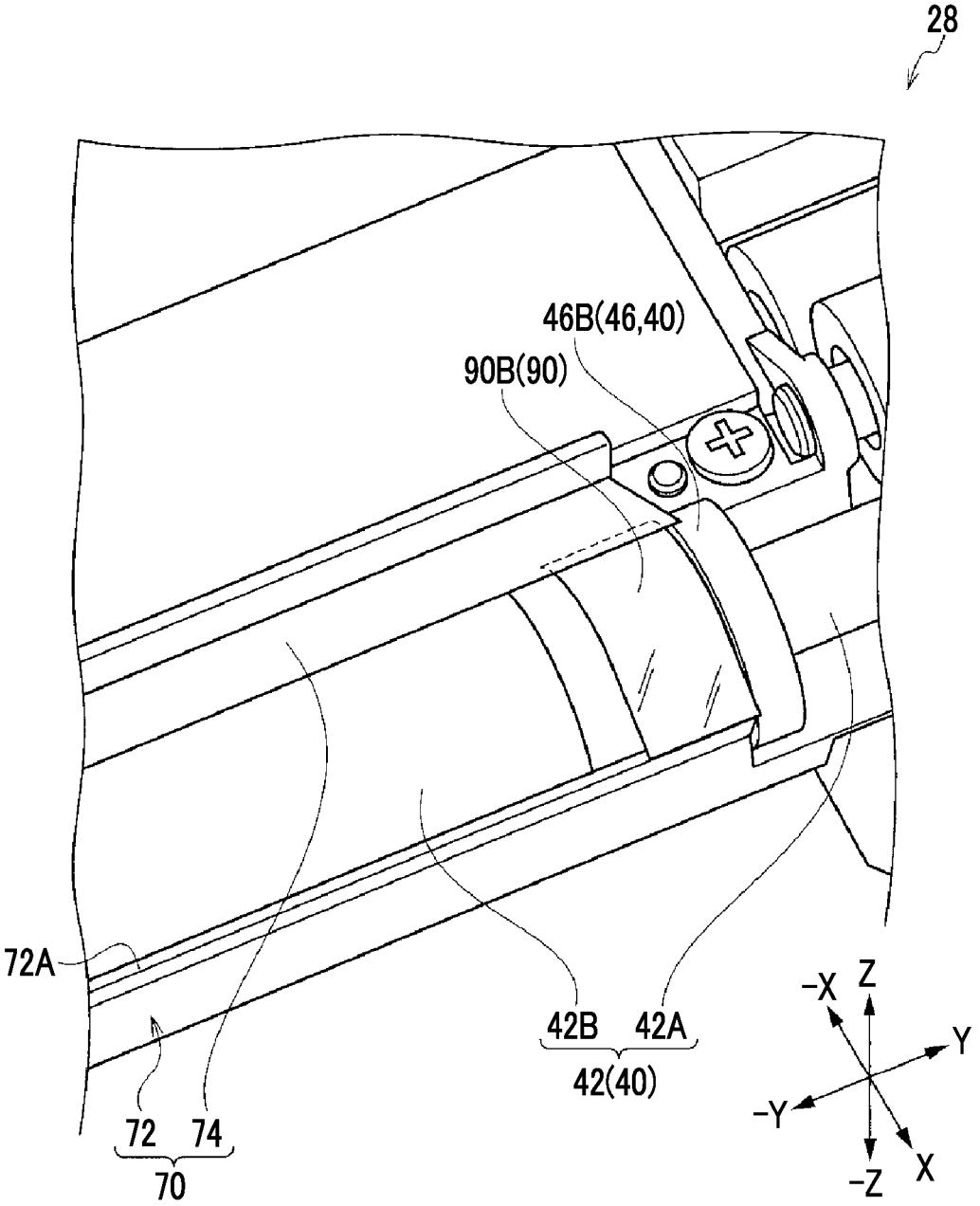
FIG. 3 is a diagram (perspective view) illustrating a portion of the developing device which constitutes the image forming apparatus according to the exemplary embodiment, on the front side in a depth direction of the device.
Figure 4:
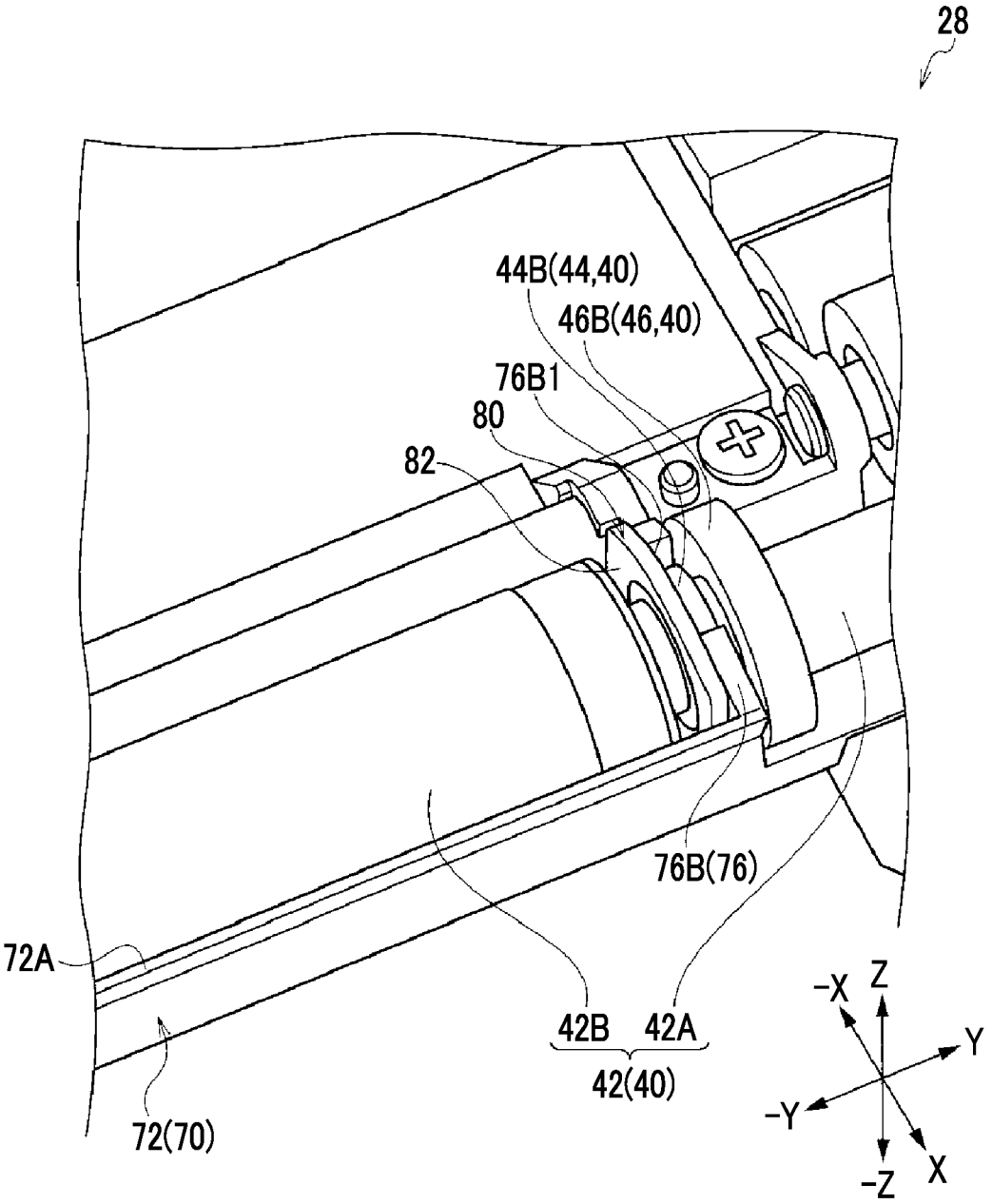
FIG. 4 is a diagram (perspective view) illustrating the portion of the developing device on the front side in the depth direction of the device in the exemplary embodiment, and is a diagram illustrating a state where a seal member is separated from the developing device.

The main component (developing device 28) in the exemplary embodiment will be described with reference to the drawings. As illustrated in FIG. 2, the developing device 28 includes a developing unit 40, a supply unit 50, a trimmer bar 60, and a housing 70. Here, the housing 70 is an example of an accommodation member. As illustrated in FIGS. 3 and 4, the developing device 28 includes a fixation member 80 and a pair of seal members 90. Here, the seal member 90 is an example of a covering member. As illustrated in FIGS. 1 and 2, the developing device 28 is disposed on a lower side of the photoreceptor 22. The developing unit 40, the supply unit 50, the trimmer bar 60, and the fixation member 80 are disposed in the housing 70.

Developing Unit

Figure 5:
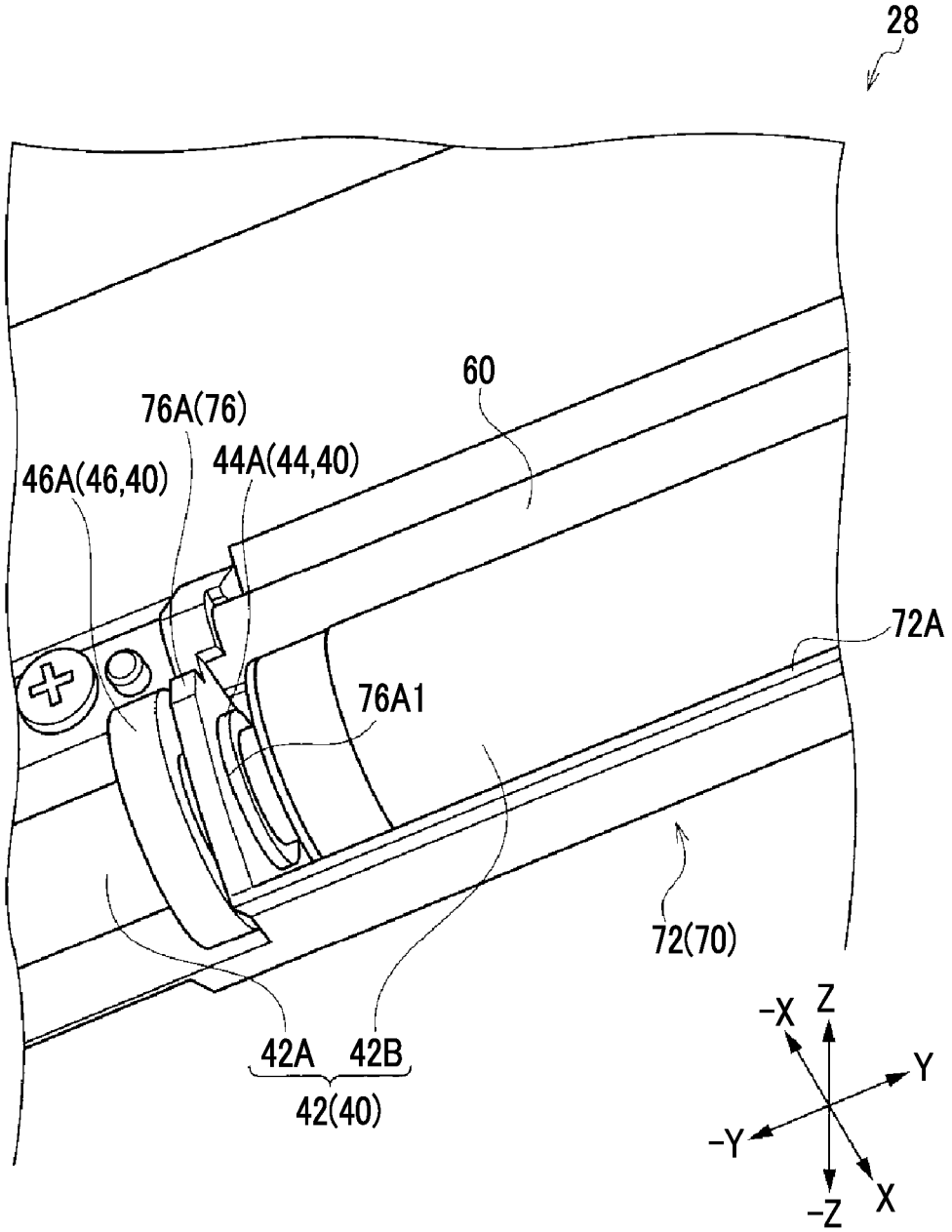
FIG. 5 is a diagram (perspective view) illustrating a portion of the developing device on a back side in the depth direction of the device in the exemplary embodiment, and is a diagram illustrating a state where a seal member is separated from the developing device.

As illustrated in FIGS. 3 to 5, the developing unit 40 includes a developing roll 42, a pair of bearings 44, and a pair of rollers 46. Each of the bearings 44 and the rollers 46 is cylindrical. Here, the developing roll 42 is an example of a rotating member.

The developing roll 42 has a function of delivering a toner supplied from the supply unit 50 to the photoreceptor 22. As illustrated in FIGS. 2 to 4, the developing roll 42 includes a rotation shaft 42A and a cylindrical main member 42B. Here, the main member 42B is an example of the holding portion. The main member 42B is provided on an outer circumference of the rotation shaft 42A in a state where the rotation shaft 42A is extruded from both ends of the main member 42B. That is, an end of the rotation shaft 42A is extruded from at least the end portion of the main member 42B. The developing roll 42 faces the photoreceptor 22 in a state where the shaft of the developing roll 42 and an axis of the photoreceptor 22 are aligned with each other (see FIGS. 1 and 2). The developing roll 42 is driven by a driving source (not illustrated) in a state of holding the toner on the outer circumference of the main member 42B, and thus the developing roll 42 develops the latent image of the photoreceptor 22 by using the toner, so as to obtain a toner image, while being rotated around the shaft. An arrow C in FIGS. 1 and 2 indicates a rotation direction of the developing roll 42. The developing device 28 in the exemplary embodiment forms a toner image by using a toner in a developer (not illustrated) which contains the toner and a carrier and is held on the outer circumference of the developing roll 42 (main member 42B) (so-called two-component developing method).

The bearings 44 are respectively fit into portions of the developing roll 42 (rotation shaft 42A) on both sides thereof (see FIGS. 4 and 5). An outer diameter of each of the bearings 44 is smaller than an outer diameter of the main member 42B of the developing roll 42. The rollers 46 are respectively fit into portions of the developing roll 42 (rotation shaft 42A) on sides which are both end sides of the rotation shaft 42A and are the outsides of the bearings 44 (see FIGS. 3 to 5). An outer diameter of each of the rollers 46 is greater than an outer diameter of the main member 42B. Contact of the rollers 46 with the outer circumference of the photoreceptor 22 causes the developing roll 42 to be positioned at the photoreceptor 22. The developing roll 42 faces the photoreceptor 22. The developing roll 42 is supported through the pair of bearings 44 by the housing 70. However, a configuration thereof will be described later. In the following descriptions, among the pair of bearings 44, the bearing 44 on the back side in the depth direction of the apparatus is set as a bearing 44A, and the bearing 44 on the front side is set as a bearing 44B. Among the pair of rollers 46, the roller 46 on the back side in the depth direction of the apparatus is set as a roller 46A and the roller 46 on the front side is set as a roller 46B.

Supply Unit

The supply unit 50 has a function of agitating the developer accommodated in the housing 70 and supplying the agitated developer to the developing roll 42. The supply unit 50 includes an agitation roller 52 and a supply roller 54. The supply unit 50 is disposed on a lower side of the developing roll 42.

Trimmer Bar

The trimmer bar 60 has a function of adjusting a thickness of a layer of the developer which is supplied to the developing roll 42 from the supply unit 50, so as to be in a range of the thickness of a layer determined along the shaft direction of the developing roll 42. As illustrated in FIGS. 1, 2, and 4, the trimmer bar 60 is columnar. As illustrated in FIG. 2, the trimmer bar 60 is disposed on a downstream side of a position of the developing roll 42 in the rotation direction (as an example, referring to a position on a two-dot chain line in FIG. 2), which faces the supply roller 54, and is disposed on an upstream side of a position of the developing roll 42, which faces the photoreceptor 22. The trimmer bar 60 faces the developing roll 42 (main member 42B) in a state where the shaft of the trimmer bar 60 and the shaft of the developing roll 42 are aligned with each other.

Housing

As described above, the housing 70 has a function of accommodating the developer. As illustrated in FIGS. 3 to 5, the housing 70 is longitudinal and is disposed in the depth direction of the apparatus. The housing 70 includes a main member 72 and a lid 74. As illustrated in FIGS. 2 to 7, an opening 72A which is long in the depth direction of the apparatus is formed at a portion on an upper side of the main member 72. The lid 74 blocks a portion of the opening 72A so as to cause the developer not to be leaked from an upper side of the trimmer bar 60.

As described above, the housing 70 supports the developing roll 42 through the pair of bearings 44. Here, a configuration of the housing 70 will be described. The housing 70 has a pair of walls 76 which face each other in the depth direction of the apparatus. Among the pair of the walls 76, the wall 76 on the back side in the depth direction of the apparatus is set as a wall 76A and the wall 76 on the front side is set as a wall 76B. A through hole 76A1 which is penetrated in the depth direction of the apparatus is formed in the wall 76A. The bearing 44A is fit into the through hole 76A1 (see FIG. 5). The roller 46A is disposed on the backside of the wall 76A in the depth direction of the apparatus, in a state where the housing 70 supports the developing roll 42. That is, the wall 76A is interposed between the main member 42B of the developing roll 42 and the roller 46A in the depth direction of the apparatus.

Meanwhile, a notch 76B1 is formed from an upper end of the wall 76B in the wall 76B. The notch 76B1 is formed by cutting out the wall 76B such that an edge when the wall 76B is viewed in the depth direction of the apparatus has a U-shape (see FIG. 6). The bearing 44B is fit into the notch 76B1 (see FIGS. 4, 6 and 7). The roller 46B is disposed on the front side of the wall 76B in the depth direction of the apparatus, in the state where the housing 70 supports the developing roll 42. That is, the wall 76B is interposed between the main member 42B of the developing roll 42 and the roller 46B in the depth direction of the apparatus. When viewed in a different direction, the developing roll 42 is disposed in the housing 70, in a state where the rotation shaft 42A of the developing roll 42 is extruded outwardly (front side in the depth direction of the apparatus) from an inside of the wall 76B (back side in the depth direction of the apparatus) through the notch 76B1.

As described above, the rollers 46 are respectively disposed on outer surface sides of the walls 76A and 76B (on an opposite side of an inner surface side of the developing roll 42, which is directed toward the main member 42B in each of the walls 76A and 76B) (see FIGS. 3 to 5). The reason is because, for example, if the rollers 46 are respectively disposed on inner surface sides of the walls 76A and 76B, the toner and the like may be attached to the outer circumferential surface of each of the rollers 46, and thus a facing distance with the photoreceptor 22 may fluctuate. In the exemplary embodiment, since the rollers 46 are respectively disposed on the outer surface sides of the walls 76A and 76B, attaching of the toner and the like to the outer circumferential surface of each of the rollers 46 may be difficult in comparison to a case where the rollers 46 are respectively disposed on inner surface sides of the walls 76A and 76B.

With such a configuration, the housing 70 supports the developing roll 42. A pair of through holes 76B2 is respectively formed on both sides of the wall 76B, between which the notch 76B1 is interposed. Here, the pair of through holes 76B2 is an example of a pair of holes of the wall.

Fixation Member

The fixation member 80 has a function of suppression of opening of the notch 76B1.

Here, the notch 76B1 is opened (facing distance fluctuates), and thus inconvenience (disadvantage) as follows may occur. For example, if the shaft of the developing roll 42 is inclined to the depth direction of the apparatus, as a result of opening of the notch 76B1, the thickness of a layer (which is adjusted by the trimmer bar 60) of the developer varies in the shaft direction of the developing roll 42 (poor adjustment in the thickness of a layer of the developer occurs). For example, if the shaft of the developing roll 42 is inclined to the depth direction of the apparatus, as a result of opening of the notch 76B1, the developing roll 42 is inclined to the photoreceptor 22 in the shaft direction of the photoreceptor 22 and faces the photoreceptor 22 (poor developing in the shaft direction of the photoreceptor 22 occurs due to an inclination of the developing roll 42). Thus, the developing device 28 in the exemplary embodiment includes the fixation member 80.

Figure 6:
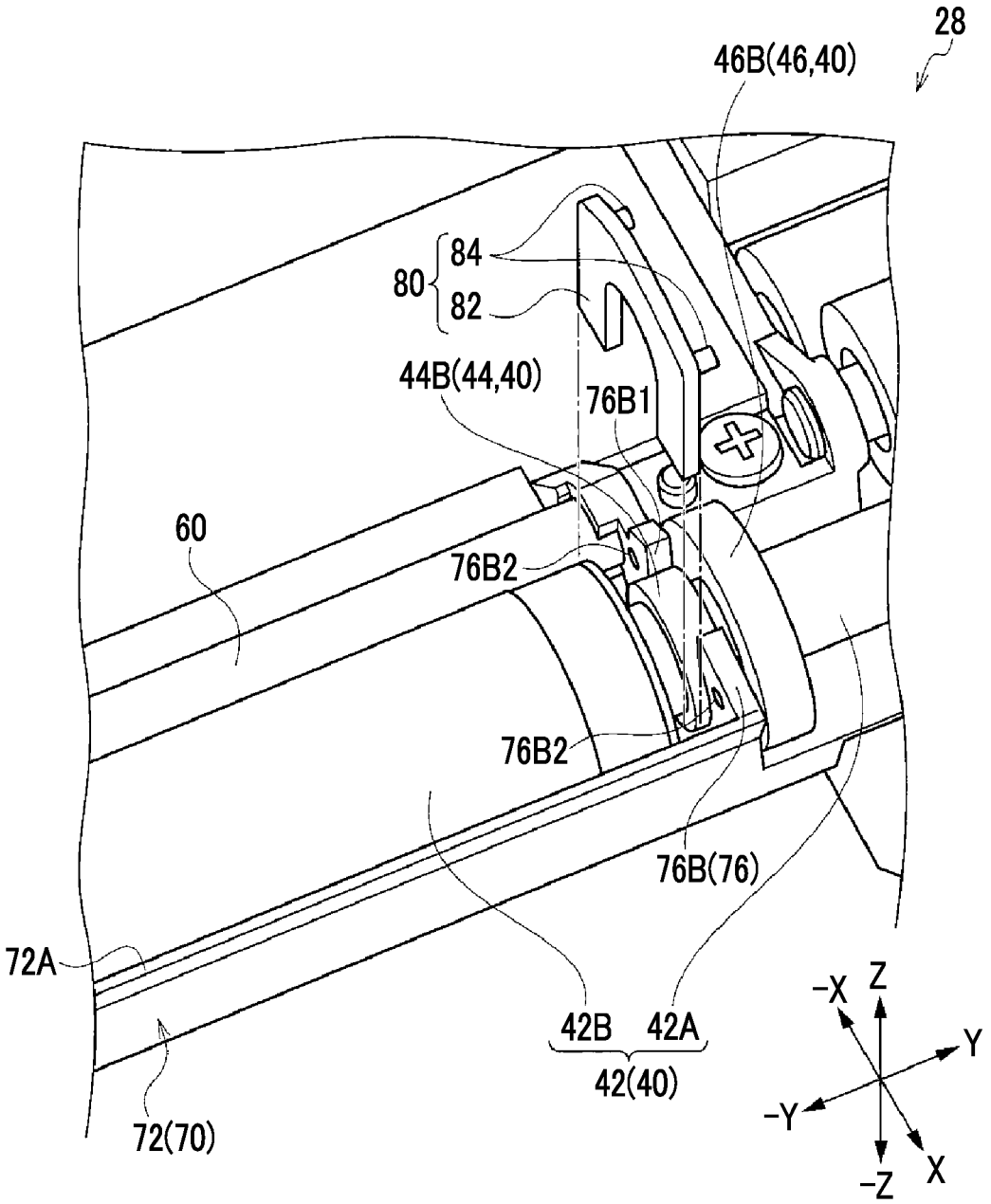
FIG. 6 is an exploded perspective view of the portion illustrated in FIG. 3.

As illustrated in FIG. 6, as the fixation member 80, a U-shaped plate 82 (referred to as the plate 82 below) of which a pair of pins 84 is formed on one surface is used. Here, the pair of pins 84 is an example of a pair of projections of the fixation member. The pair of pins 84 is fit into the pair of through holes 76B2 of the wall 76B of the housing 70, and thus the fixation member 80 is fixed to the inner surfaces (surfaces on the back side in the depth direction of the apparatus) of the wall 76B on both sides, between which the notch 76B1 is interposed (see FIG. 4). Accordingly, the fixation member 80 suppresses opening of the notch 76B1 during the rotation of the developing roll 42 around the shaft thereof.

Figure 7:
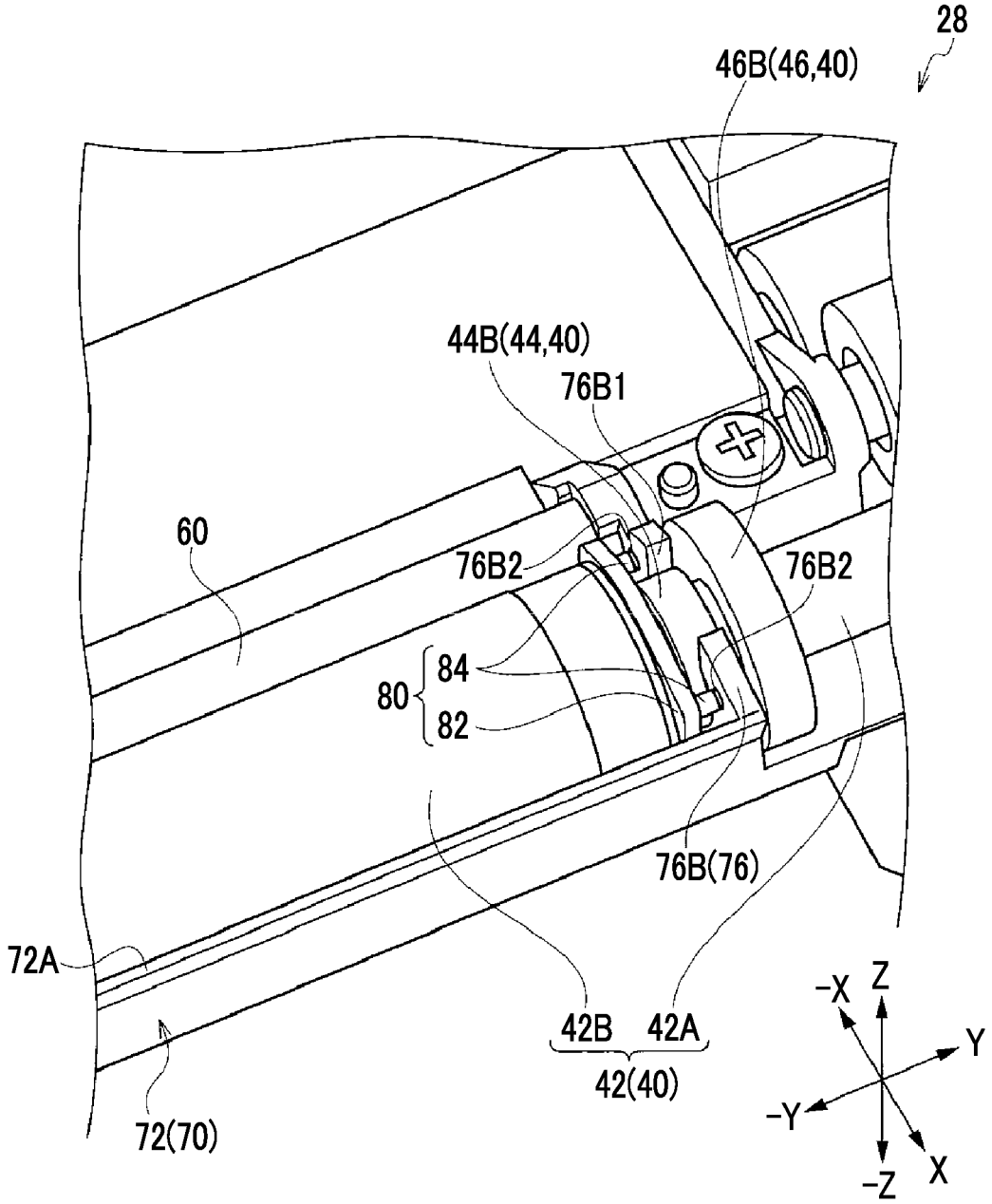
FIG. 7 is a diagram (perspective view) illustrating a portion of the developing device on the front side in the depth direction of the device in the exemplary embodiment, and is a diagram illustrating a state where a pair of projections of a fixation member is fit into a pair of holes formed on an inner surface of a wall of a housing.

The fixation member 80 overlaps the main member 42B of the developing roll 42 in the depth direction of the apparatus, that is, if viewed from the shaft direction of the developing roll 42 (see FIGS. 4 and 7). In other words, the fixation member 80 is disposed between the main member 42B of the developing roll 42 and the wall 76B which face each other.

Seal Member

The pair of seal members 90 has a function of respectively covering the end portions of the main member 42B of the developing roll 42 and the walls 76A and 76B from an upper side (photoreceptor 22 side), and suppressing leakage of the toner from the opening 72A in the housing 70. Each of the seal members 90 is a rectangular sheet having flexibility. Among the pair of seal members 90, in the seal member 90 (referred to as a seal member 90B below) on the front side in the depth direction of the apparatus, a portion on one end side in a longitudinal direction adheres to the lid 74. The seal member 90B adheres to a portion of the fixation member 80 on an upper side thereof from the one end side in the longitudinal direction over another end side. Among the pair of seal members 90, the seal member 90 on the back side in the depth direction of the apparatus is not illustrated. However, the seal member 90 on the back side is similar to the seal member 90B except that the seal member 90 on the back side does not adhere to the portion of the fixation member 80 on the upper side.

Complement (Reason of Formation of Notch in Wall of Housing)

Hereinafter, a reason that the notch 76B1 is formed in the wall 76B of the housing 70 will be described. It is assumed that the notch 76B1 is not formed in the wall 76B of the housing 70, but the through holes 76A1 are formed in the wall 76B of the housing 70, as with the wall 76A. That is, it is assumed that the through holes 76A1 are formed in the walls 76A and 76B. When the developing roll 42 is mounted in the housing 70 in this configuration, it is necessary that one end side of the rotation shaft 42A of the developing roll 42 pass through one through hole 76A1 and another end side of the rotation shaft 42A pass through another through hole 76A1. Thus, the width of the developing device 28 in a longitudinal direction of the opening 72A is required to be equal to or greater than summation of at least the width of the main member 42B of the developing roll 42 (length of the main member 42B in the shaft direction), and the length of the rotation shaft 42A extruded from the main member 42B toward the other side of the rotation shaft 42A. On the contrary, in the exemplary embodiment, the notch 76B1 is formed in the wall 76B. Thus, when the developing roll 42 is mounted in the housing 70, one end side of the rotation shaft 42A of the developing roll 42 may pass through one through hole 76A1, and then another end side of the rotation shaft 42A may be moved from the upper side of the wall 76B. That is, in the exemplary embodiment, the width of the developing device 28 (length of the developing roll 42 in the shaft direction) may be reduced in comparison to the above assumed configuration. Hitherto, the reason of formation of the notch 76B1 in the wall 76B of the housing 70 is described.

The above descriptions are made for the main component (developing device 28) of the image forming apparatus 10.

Effects

Next, effects of the exemplary embodiment will be described.

First, the effects (first to fourth effects) of the exemplary embodiment will be described by comparing the exemplary embodiment to comparative examples (first to third comparative examples) which are assumed as follows. Illustration of each of the comparative examples will be omitted. However, in descriptions for each of the comparative examples, when components and the like which are the same as those used in the exemplary embodiment are used, the reference signs of the components and the like in the exemplary embodiment are used as is.

First Effect

A first effect is an effect obtained by fixing the fixation member 80 to the inner surface (surface on the back side in the depth direction of the apparatus) of the wall 76B. The first effect will be described below by comparing the exemplary embodiment and a first comparative example (which will be described later).

In a developing device in the first comparative example, the fixation member 80 is fixed to both sides of an outer surface (surface on the front side in the depth direction of the apparatus) of the wall 76B, between which the notch 76B1 is interposed. The developing device (assembly, image forming apparatus) of the first comparative example has a configuration similar to a case of the exemplary embodiment except for the above point.

In a case of the first comparative example, because the fixation member 80 is fixed to the outer surface of the wall 76B, it is necessary that the roller 46B on the front side in the depth direction of the apparatus is disposed on the front side of the fixation member 80 in the depth direction of the apparatus. That is, in the case of the first comparative example, the width of the developing device 28 may be increased as much as an amount obtained by ensuring at least a disposition location of the fixation member 80. Thus, the width of the photoreceptor 22 may be increased.

On the contrary, in the developing device 28 of the exemplary embodiment, as illustrated in FIG. 4, the fixation member 80 is fixed to the inner surface of the wall 76B. Thus, in the case of the exemplary embodiment, it is unnecessary that the disposition location of the fixation member 80 is ensured between the wall 76B and the roller 46B.

Accordingly, according to the developing device 28 of the exemplary embodiment, the size of the developing device 28 in the shaft direction of the developing roll 42 may be reduced in comparison to a case where the fixation member 80 is fixed to the outer surface of the wall 76B. Thus, the size of the cartridge 21 (image forming apparatus 10) of the exemplary embodiment in the shaft direction of the developing roll 42 may be reduced in comparison to a case where the fixation member 80 is fixed to the outer surface of the wall 76B.

Second Effect

The second effect is an effect obtained by fixing the fixation member 80 to the inner surface of the wall 76B and disposing the fixation member 80 between the main member 42B of the developing roll 42 and the wall 76B which face each other. The second effect will be described below by comparing the exemplary embodiment and a first comparative example.

As described above, in the developing device in the first comparative example, the fixation member 80 is fixed to the outer surface of the wall 76B. That is, in the case of the first comparative example, the fixation member 80 is not disposed between the wall 76B and the main member 42B of the developing roll 42. Thus, if the developing roll 42 is shifted in the shaft direction, the developing roll 42 may be moved to a position at which an end surface of the main member 42B reaches the inner surface of the wall 76B.

On the contrary, in the developing device 28 of the exemplary embodiment, as illustrated in FIG. 4, the fixation member 80 is disposed between the wall 76B and the main member 42B of the developing roll 42 which face each other. Thus, even when the developing roll 42 is shifted in the shaft direction, the developing roll 42 is not moved to a position at which the end surface of the main member 42B reaches the inner surface of the wall 76B.

Accordingly, according to the developing device 28 of the exemplary embodiment, a shift of a position of the developing roll 42 in the shaft direction is suppressed in comparison to a case where the fixation member 80 is fixed to the outer surface of the wall 76B, and the fixation member 80 is not disposed between the facing surfaces of the main member 42B and the wall 76B.

Third Effect

The third effect is an effect obtained by fitting the pair of pins 84 of the fixation member 80 into the pair of through holes 76B2 of the wall 76B so as to fix the fixation member 80 to the wall 76B. In other words, the third effect is an effect obtained by fixing the fixation member 80 to the wall 76B using a fitting mechanism. The third effect will be described below by comparing the exemplary embodiment and a second comparative example (which will be described later).

In a case of the second comparative example, the pair of pins 84 is not formed on one surface of the fixation member and the pair of through holes 76B2 is not formed on the wall 76B. Thus, in the case of the second comparative example, the fixation member adheres and is fixed to the inner surface of the wall 76B by using an adhesive (not illustrated). The developing device (assembly, image forming apparatus) of the second comparative example has a configuration similar to a case of the exemplary embodiment except for the above point.

In the case of the second comparative example, because one surface of the fixation member and the inner surface of the wall 76B adhere to each other and thus the fixation member is fixed, a position of the fixation member fixed to the wall 76B may vary. For example, when an operator fixes the fixation member, it is difficult that the operator visually confirms whether the position at which the fixation member is fixed is in an allowable range (for example, in practice, it is necessarily confirmed whether the position at which the fixation member is fixed is in the allowable range, by manufacturing a developing device and forming a toner image).

On the contrary, in the developing device 28 of the exemplary embodiment, as illustrated in FIGS. 5 and 6, the pair of pins 84 of the fixation member 80 is fit into the pair of through holes 76B2 of the wall 76B and thus the fixation member 80 is fixed to the wall 76B. That is, in the case of the exemplary embodiment, because the fixation member 80 is fixed by using the fitting mechanism, the position of the fixation member 80 fixed to the wall 76B varies small in comparison to the second comparative example. The operator may easily confirm whether the position at which the fixation member 80 is fixed is in the allowable range, based on fitting of the pair of pins 84 of the fixation member 80 into the pair of through holes 76B2 of the wall 76B (for example, the operator may perform confirmation visually from the outer surface side of the wall 76B).

Accordingly, according to the developing device 28 of the exemplary embodiment, the position of the fixation member 80 fixed to the wall 76B varies small in comparison to a case where the fixation member 80 is fixed to the wall 76B without the fitting mechanism.

Fourth Effect

The fourth effect is an effect obtained by causing the seal member 90B which is disposed on the front side in the depth direction of the apparatus, to adhere to the fixation member 80. The fourth effect will be described below by comparing the exemplary embodiment and a third comparative example (which will be described later).

In a developing device of the third comparative example, the seal member 90B does not adhere to the fixation member 80. The developing device (assembly, image forming apparatus) of the third comparative example has a configuration similar to a case of the exemplary embodiment except for the above point. Because the third comparative example includes a configuration for exhibiting the above-described first to third effects, the third comparative example is included in the technical range of the invention.

Because the seal member 90B in the third comparative example does not adhere to the fixation member 80, the seal member 90B may be movable between the fixation member 80 and the photoreceptor 22. That is, a gap may be formed between the seal member 90B and the fixation member 80. Thus, in the developing device 28, the toner which has been leaked from a space between the end portion of the main member 42B of the developing roll 42 and the fixation member 80 may be leaked from the gap between the seal member 90A and the fixation member 80.

On the contrary, in the developing device 28 of the exemplary embodiment, the seal member 90B adheres to the fixation member 80 (see FIG. 4). Thus, formation of the gap between the seal member 90B and the fixation member 80 is difficult (or there is no gap).

Accordingly, according to the developing device 28 of the exemplary embodiment, an amount of the toner leaked from the housing 70 is reduced in comparison to a case where the seal member 90B does not adhere to the fixation member 80.

Hitherto, the effects of the exemplary embodiment are described.

As described above, specific exemplary embodiments of the invention are described in detail. However, the technical range of the invention is not limited to the above-described exemplary embodiments. For example, a form as follows is also included in the technical range of the invention.

In the developing device 28 of the exemplary embodiment, a case where a toner image is formed by using a developer which contains a toner and a carrier is described. However, the developing device may form a toner image by using a developer without the carrier (as an example, non-magnetic one-component toner). In this developing device, the first to fourth effects are exhibited similarly to the case of the exemplary embodiment in that poor adjustment of the thickness of a layer occurs by a layer regulation member (as an example, regulation blade) instead of the trimmer bar 60 in the exemplary embodiment, poor developing in the shaft direction of the photoreceptor 22 occurs by inclination of the developing roll 42, poor developing in a circumferential direction of the photoreceptor 22 occurs by periodic inclination of the developing roll 42.

In the case of the developing device 28 of the exemplary embodiment, a case where the notch 76B1 is formed on the front side of the wall 76B in the depth direction of the apparatus, and thus the fixation member 80 is fixed to the wall 76B is described. However, the notch 76B1 may be formed on the back side of the wall 76A in the depth direction of the apparatus instead of the wall 76B. In this case, the fixation member 80 is fixed to the wall 76A. The notch 76B1 may be formed in the wall 76B and the wall 76A. In this case, a pair of the fixation members 80 is used and is respectively fixed to the walls 76A and 76B.

Figure 8:
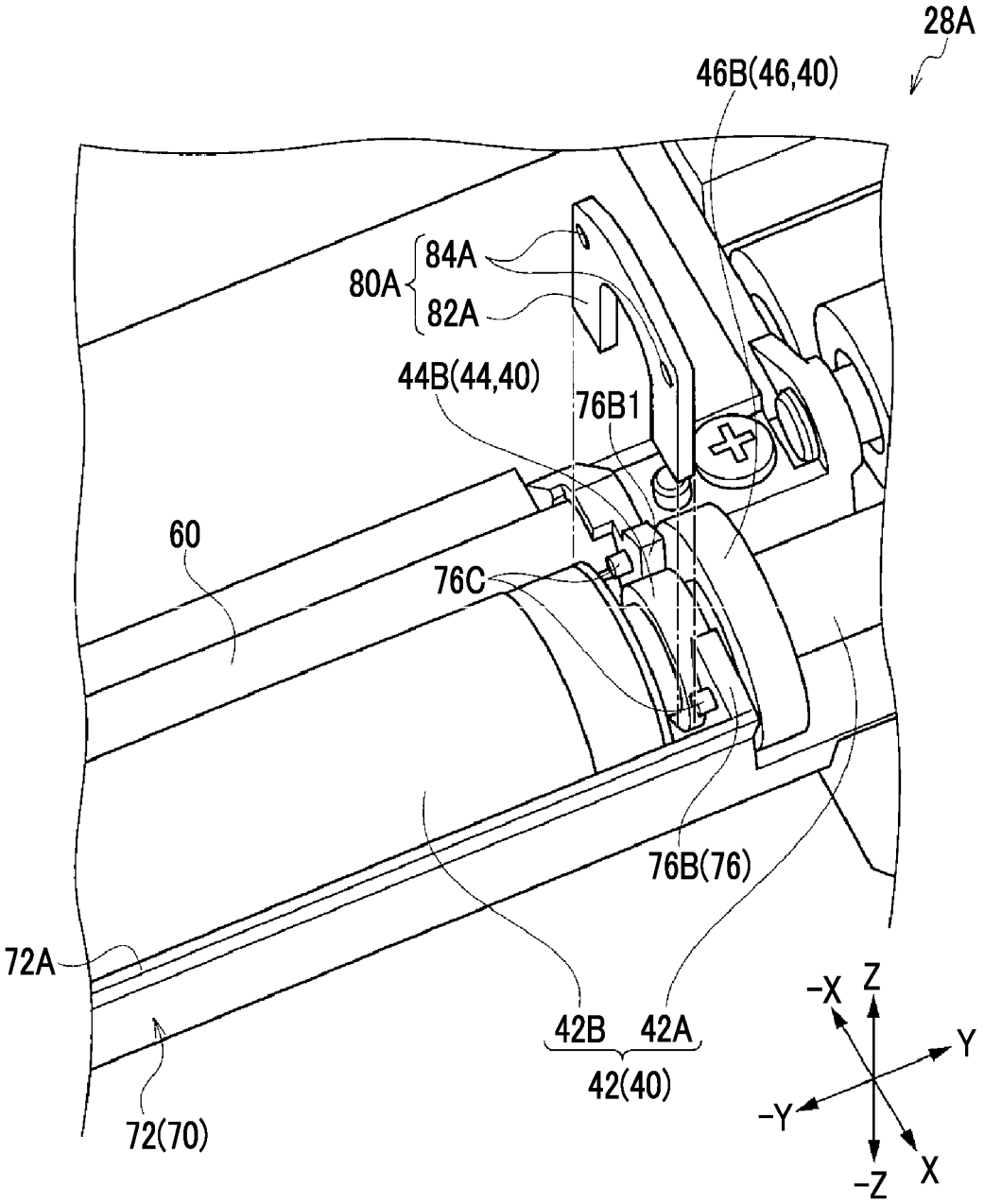
FIG. 8 is an exploded perspective view of a portion of a developing device according to a modification example (first modification example), on the front side in a depth direction of the device.

In the developing device 28 of the exemplary embodiment, a case where the pair of pins 84 of the fixation member 80 is fit into the pair of through holes 76B2 of the wall 76B and thus the fixation member 80 is fixed to the wall 76B is described (FIGS. 4, 6, and 7). However, a form different from the exemplary embodiment may be made as long as the fixation member 80 is fixed to the wall 76B by using the fitting mechanism. For example, a developing device 28A (first modification example) of FIG. 8 includes a U-shaped plate 82A (fixation member 80A) in which a pair of through holes 84A is formed in a plate thickness direction, and a wall 76B in which a pair of pins 76C protruding toward an inner surface side thereof is formed. In the developing device 28A, the pair of pins 76C of the wall 76B is fit into the pair of through holes 84A of the fixation member 80A, and thus the fixation member 80A is fixed to the wall 76B. Here, the pair of through holes 84A of the fixation member 80A is an example of a pair of holes of the fixation member. The pair of pins 76C of the wall 76B is an example of a pair of projections of the wall. In the case of the developing device 28A, because the pair of through holes 84A is formed in the fixation member 80A, the operator may easily confirm that the pair of pins 76C is fit into the pair of through holes 84A (for example, may perform confirmation visually from the inner surface side of the wall 76B) when the developing device 28A is manufactured.

Figure 9:
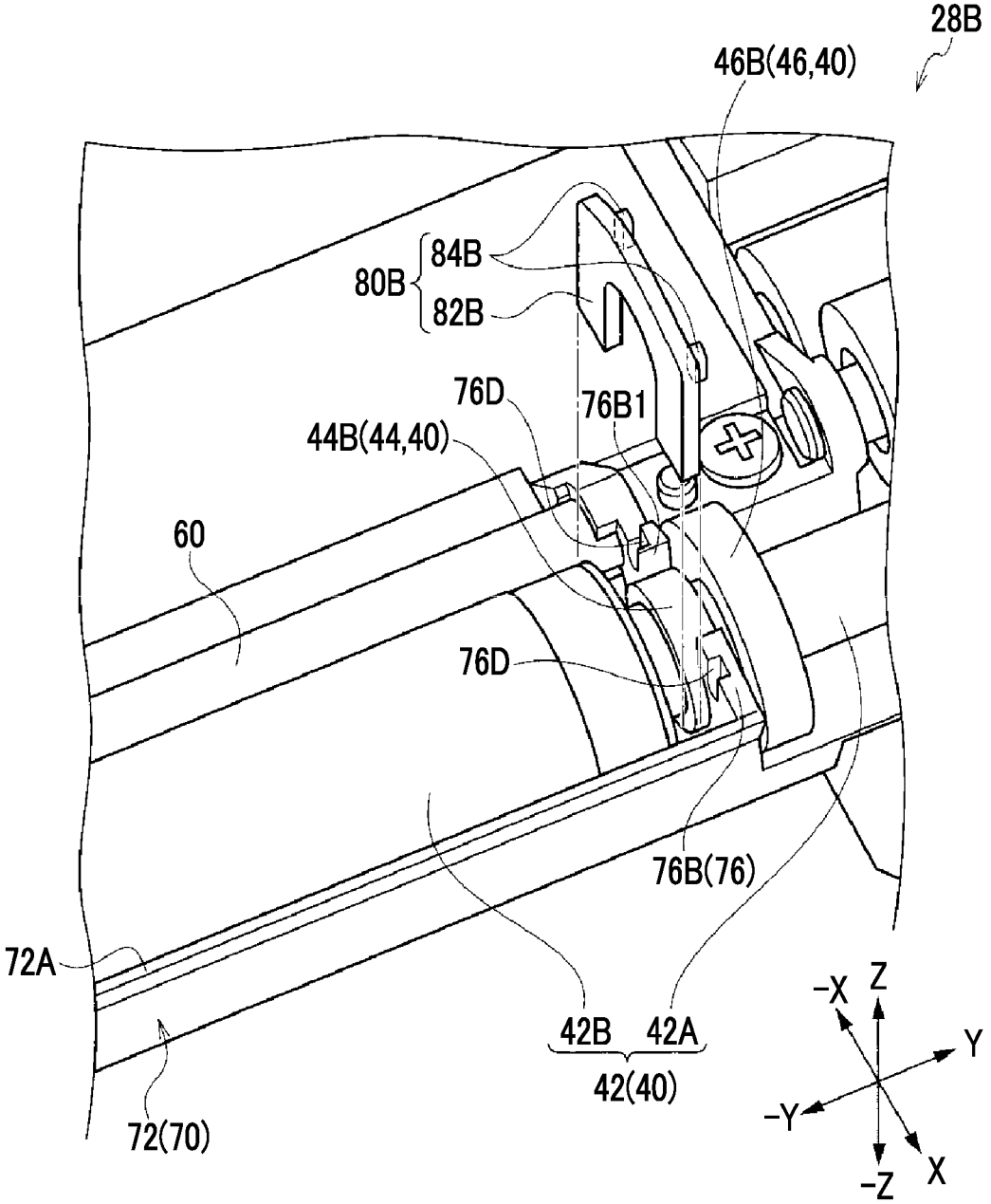
FIG. 9 is an exploded perspective view of a portion of a developing device according to a modification example (second modification example), on the front side in a depth direction of the device.

For example, a developing device 28B (second modification example) of FIG. 9 includes a U-shaped plate 82B (fixation member 80B) in which a pair of projections 84B is formed in a plate thickness direction, and a wall 76B in which a pair of notches 76D which is cut out downwardly from an upper end thereof is formed. Thus, in the developing device 28B, the pair of projections 84B of the fixation member 80B is fit into the pair of notches 76D of the wall 76B and thus the fixation member 80B is fixed to the wall 76B. Here, the pair of projections 84B of the fixation member 80A is an example of a pair of projections of the fixation member. The pair of notches 76D of the wall 76B is an example of the pair of holes of the wall. In the case of the developing device 28B, differently from the cases of the developing devices 28 and 28A, the fixation member 80B may be fixed to the wall 76B without disposition of the fixation member 80B between the developing roll 42 and the wall 76B which face each other, and then moving of the fixation member 80B in the shaft direction of the developing roll 42. That is, the size of the developing device 28B may be reduced in the shaft direction of the developing roll 42, in comparison to the developing devices 28 and 28A.

In the case of the developing device 28 of the exemplary embodiment, a case where the pair of pins 84 is formed in the fixation member 80 and the pair of through holes 76B2 is formed in the wall 76B is described. However, a pin 84 and a through hole 76B2 may be formed in the fixation member 80 and a through hole 76B2 and a pin 84 may be formed in the wall 76B. Thus, the pin 84 of the fixation member 80 maybe fit into the through hole 76B2 of the wall 76B and the pin 84 of the wall 76B may be fit into the through hole 76B2 of the fixation member 80, and thus the fixation member 80 may be fixed to the wall 76B.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a rotating member that faces a formation target member on which a toner image is formed, is rotated around a rotation shaft extruded from an end portion, and includes a holding portion having an outer circumference on which a toner is held;

an accommodation member that accommodates the toner, includes a wall at which a notch is formed, and in which the rotating member is disposed in a state where the rotation shaft is extruded outwardly from an inner surface of the wall through the notch; and a fixation member that is fixed on both sides of an inner surface of the wall with interposing the notch.

2. The developing device according to claim 1, wherein the fixation member is disposed between the holding portion and the wall which face each other.

3. The developing device according to claim 2, wherein a pair of projections is formed in the fixation member, a pair of holes is formed on both of the sides of the wall with interposing the notch, and the pair of projections of the fixation member is fit into the pair of holes of the wall so that the fixation member is fixed to both of the sides of the inner surface of the wall with interposing the notch.

4. The developing device according to claim 3, further comprising:

a covering member that covers an end portion of the holding portion in an axial direction and the fixation member from a formation target member side so as to suppress leakage of the toner from the accommodation member, and adheres to the fixation member.

5. The developing device according to claim 2, wherein a pair of holes is formed in the fixation member, a pair of projections is formed on both of the sides of the wall with interposing the notch, and the pair of projections of the wall is fit into the pair of holes of the fixation member so that the fixation member is fixed to both of the sides of the inner surface of the wall with interposing the notch.

6. The developing device according to claim 5, further comprising:

a covering member that covers an end portion of the holding portion in an axial direction and the fixation member from a formation target member side so as to suppress leakage of the toner from the accommodation member, and adheres to the fixation member.

7. The developing device according to claim 2, further comprising:

a covering member that covers an end portion of the holding portion in an axial direction and the fixation member from a formation target member side so as to suppress leakage of the toner from the accommodation member, and adheres to the fixation member.

8. The developing device according to claim 1, wherein a pair of projections is formed in the fixation member, a pair of holes is formed on both of the sides of the wall with interposing the notch, and the pair of projections of the fixation member is fit into the pair of holes of the wall so that the fixation member is fixed to both of the sides of the inner surface of the wall with interposing the notch.

9. The developing device according to claim 8, further comprising:

a covering member that covers an end portion of the holding portion in an axial direction and the fixation member from a formation target member side so as to suppress leakage of the toner from the accommodation member, and adheres to the fixation member.

10. The developing device according to claim 1, wherein a pair of holes is formed in the fixation member, a pair of projections is formed on both of the sides of the wall with interposing the notch, and the pair of projections of the wall is fit into the pair of holes of the fixation member so that the fixation member is fixed to both of the sides of the inner surface of the wall with interposing the notch.

11. The developing device according to claim 10, further comprising:

a covering member that covers an end portion of the holding portion in an axial direction and the fixation member from a formation target member side so as to suppress leakage of the toner from the accommodation member, and adheres to the fixation member.

12. The developing device according to claim 1, further comprising:

a covering member that covers an end portion of the holding portion in an axial direction and the fixation member from a formation target member side so as to suppress leakage of the toner from the accommodation member, and adheres to the fixation member.

13. An assembly comprising:

the developing device according to claim 1; and a formation target member that is disposed to face the rotating member and on which a toner image is formed with a toner held on the rotating member, and is attachable to a main body of an image forming apparatus, wherein the developing device and the formation target member are integral.

14. An image forming apparatus comprising:

the developing device according to claim 1;

a formation target member that is disposed to face the rotating member and on which a toner image is formed with a toner held on the rotating member; and a transfer device that transfers a toner image formed on the formation target member onto a medium.

* * * * *